US006102066A

United States Patent [19]

Craig et al.

[11] Patent Number: 6,102,066

[45] Date of Patent: Aug. 15, 2000

[54] CONDENSATE DRAIN FOR AN AUTOMATIC SPRINKLER SYSTEM OF THE DRY-PIPE TYPE

[76] Inventors: Robert A. Craig, 3848 Hoiles Ave., Toledo, Ohio 43612; Robert L. Wilkinson, 27695 Tracy Rd., Walbridge, Ohio 43465

[21] Appl. No.: 09/299,430

[22] Filed: Apr. 26, 1999

Related U.S. Application Data

[60] Provisional application No. 60/083,377, Apr. 28, 1998.

[51] Int. Cl.[7] ..... A62C 35/00

[52] U.S. Cl. ..... 137/312; 137/613; 169/17

[58] Field of Search ..... 169/17; 137/613, 137/312, 314

[56] References Cited

U.S. PATENT DOCUMENTS

| | | | |
|---|---|---|---|
| 893,033 | 7/1908 | Thompson | 169/17 |
| 1,326,922 | 6/1920 | Ecks | 169/17 |
| 2,376,212 | 5/1945 | Warren | 137/312 |
| 5,821,403 | 10/1998 | Montgomery | 73/40.5 R |

FOREIGN PATENT DOCUMENTS

| | | | |
|---|---|---|---|
| 1155650 | 10/1963 | Germany | 137/312 |
| 668925 | 3/1952 | United Kingdom | 137/314 |

*Primary Examiner*—A. Michael Chambers
*Attorney, Agent, or Firm*—Donald R. Fraser

[57] ABSTRACT

A condensate drain for an automatc sprinkler system of the dry-pipe type wherein the drain includes a one piece reservoir having a central chamber and tapering inlet and outlet chambers.

20 Claims, 1 Drawing Sheet

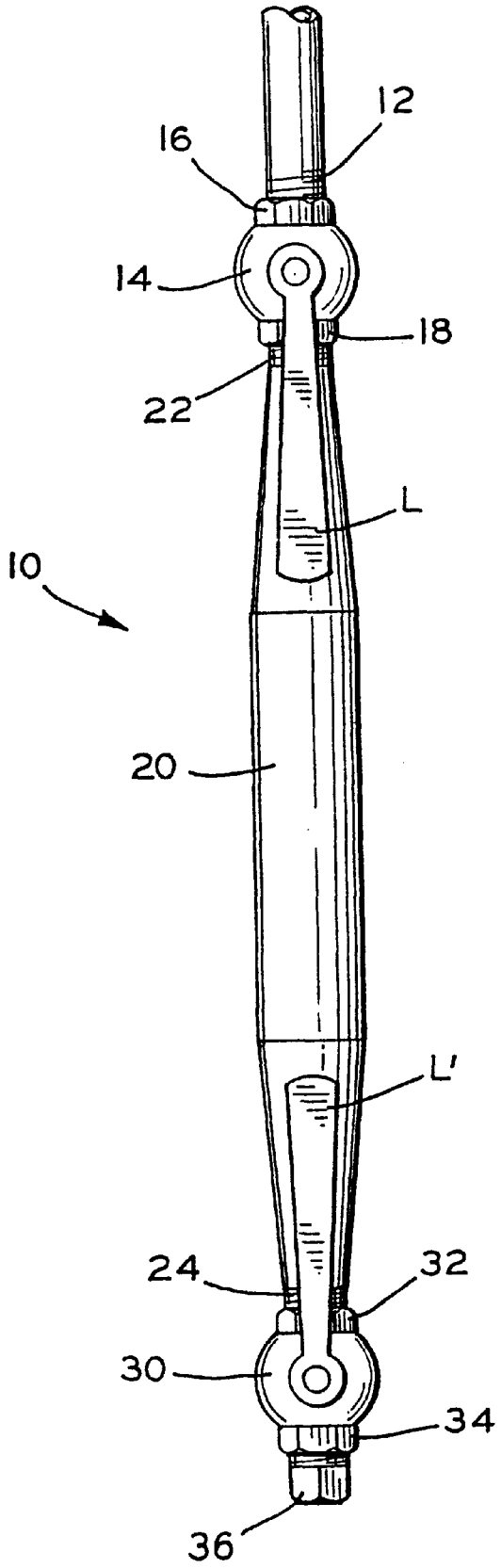
12
16
14
18
22
L
10
20
L'
24
32
30
34
36

CONDENSATE DRAIN FOR AN AUTOMATIC SPRINKLER SYSTEM OF THE DRY-PIPE TYPE

This is a continuation of Provisional patent application Ser. No. 60/083,377, filed Apr. 28, 1998.

FIELD OF THE INVENTION

This invention relates to a condensate drain for an automatic sprinkler system of the dry-pipe type, typically for use in systems susceptible to freezing such as, for example, in unheated buildings. More particularly, the invention is directed to a condensate drain capable of periodic removal of condensate from dry-pipe type sprinkler systems without excessively changing the pressure effective to activate the system.

BACKGROUND OF THE INVENTION

Automatic sprinkler systems typically comprise an adequate water supply, hydraulically designed internal piping and sprinklers connected in a systematic pattern over the protected area. The system is activated by a fire to discharge a fine spray of water over the heat affected by a fire.

The essential features of such a system include an inherent ability to detect fire, prior installation, and built-in associated activation means. The automatic sprinkler system is amongst the earliest-used architectural features that contribute actively to maintenance of internal environment.

Automatic sprinklers are the most widely used fixed apparatus for fire protection. The water spray acts four ways:

- it cools burning material by conversion of water to steam;
- the steam displaces the oxygen supply, thereby tending to smother the fire;
- the spray limits the supply of new fuel by dampening materials in the area; and
- the spray lowers the temperature in the vicinity by evaporative cooling.

Through prompt response, an automatic sprinkler system generally requires less water to control a fire than does a hose. The vertical spray produces less mechanical damage than does a horizontal hose stream. A sprinkler system is considered effective if it extinguishes or checks a fire until fire-fighting forces arrive. Failure of such systems principally occur when the systems have been rendered inoperative during building alternation or disuse, or the occupancy hazard has been increased beyond initial system capability.

Typically, the water supply for a sprinkler system is separate from that used by a fire department. Normally, no water flows in the supply lines to the sprinklers, thus freezing is a greater risk than in mains with continuous flow. Standards require sprinkler mains to be buried well below the frost line. The underground main enters the building in a heated area to supply a riser.

Connected at the riser are valves, meters, and often an alarm to sound when flow exceeds a predetermined minimum. At the top of the vertical riser, a horizontally disposed array of pipes extends throughout the fire compartment in the building. Other risers feed distribution networks to systems in adjacent fire compartments. Compartmentalization divides a large building horizontally, on a single floor, and vertically, floor to floor. Thus, several sprinkler systems may serve one building.

In the distribution network, branch lines carry the sprinklers. A sprinkler may extend up from a branch line, placing the sprinkler close to the ceiling, or a sprinkler can be below the branch line. For use with concealed piping, a flush-mounted pendant sprinkler extends only slightly below the ceiling.

The principal component of the system is a thermally sensitive sprinkler with a linkage assembly that holds closed the discharge opening. In various designs, the assembly is disrupted through a low-melting point chemical, a frangible bulb filled with liquid, a bimetallic disk, or usually a low-melting-point alloy link. The linkage separates above the operating range which may be any one of a number of standard steps from 100° F. (38° C.) to 475° F. (246° C.). Then, the sprinkler abruptly opens to discharge water against a deflector so that water falls in a hemispherical spray across the area below.

Water reaches the sprinklers in different basic setups. In the usual wet-pipe system, for heated buildings, all pipes contain water under pressure for immediate release through any sprinkler that opens.

In the dry-pipe system which includes pipes, risers, and feed mains which pass through open areas, cold rooms, passageways, or other areas exposed to freezing such as unheated buildings in freezing climates or for cold-storage rooms, branch lines and other distribution pipes contain dry air or nitrogen under pressure. This pressure holds closed a dry pipe valve at the riser. When heat from a fire opens a sprinkler, the air escapes and the dry-pipe valve trips; water enters branch lines; and fire suppression begins.

It will be appreciated that sprinkler systems require means to enable the system to be drained. In the dry-pipe systems, it is the typical practice to provide an auxiliary drain to facilitate the periodic drainage. The auxiliary drain may be located in a riser and positioned at a level to collect water which may become present in the distribution system. In climatic conditions that experience changes in temperature, the piping of a dry-pipe type system may collect condensate that must, from time to time, be drained from the system.

Typically, auxiliary condensate drains are disposed in a riser pipe and have an inlet end in fluid communication with the pipe network of the system and an outlet end in fluid communication with a sewer, for example. The inlet and outlet ends are provided with normally closed one inch (25.4 mm) valves. A fluid reservoir for collecting condensate from the system is disposed between the inlet and outlet valves. The reservoir is formed of a main pipe having a two inch (50 mm) O.D. and length of approximately twelve inches (305 mm). The inlet end of the inlet valve is attached to the outlet of a one inch O.D. riser of the sprinkler system, while the outlet end is coupled to the inlet of a reducer member coupled to the inlet of the main reservoir pipe.

The outlet of the main reservoir riser is coupled to a reducer. The other end of the reducer is coupled to the inlet of the outlet valve. The outlet of the outlet valve is provided with a one inch (25 mm) nipple and cap or plug.

Connections between the valves, reducers, and reservoir are typically threaded-type couplings which are costly to fabricate, time consuming to install and repair, and are subject to leakage.

The object of the present invention is to produce an auxiliary condensate drain for dry-pipe type sprinkler systems that may be economically manufactured, easily installed and readily repaired and maintained.

Another object of the invention is to produce an auxiliary condensate drain for dry-pipe type sprinkler systems that will reduce the number of connections required thereby reducing the potential for leaks to develop.

SUMMARY OF THE INVENTION

The above as well as other objects and advantages of the invention may be readily achieved by an auxiliary condensate drain for dry-type sprinkler system including a one-piece reservoir threadably connected to inlet and outlet valves. This invention may be economically manufactured and easily installed, repaired, and maintained, and has resulted in a surprisingly efficient system. The auxiliary condensate drain for dry type sprinkler systems comprises:

a first normally closed valve having an inlet communicating with the sprinkler system, and an outlet;

a second normally closed valve having an outlet communicating with a remote drain; and a one-piece reservoir having a main fluid containing center chamber of a first diametrical dimension and spaced apart inlet and outlet connections of a second diametrical dimension less than the first diametrical dimension of the center chamber, the inlet being in fluid-tight communication with the outlet of the first valve and the outlet being in fluid-tight communication with the inlet of the second valve.

BRIEF DESCRIPTION OF THE DRAWINGS

The objectives and advantages of the invention will become readily apparent to one skilled in the art from reading the following description of an embodiment of the invention while considered in the light of the attached drawings, in which:

FIG. 1 is a schematic illustration of the structural components of the invention.

DETAILED DESCRIPTION OF THE ILLUSTRATED EMBODIMENT

Referring to the drawing, there is illustrated an auxiliary condensate drain for a dry-pipe sprinkler system.

The condensate drain is generally identified by reference numeral 10 which is adapted to be connected to the outlet end 12 of a riser pipe of an associated dry-pipe sprinkler system (not shown). The condensate drain 10 is typically disposed between the outlet end 12 of the sprinkler system and a remote sewer, for example (not shown).

More specifically, the condensate drain 10 of the invention includes a first normally closed valve 14, a centrally disposed condensate reservoir 20, and a second normally closed valve 30. The condensate drain may be constructed with approved sprinkler pipe commercially available under the designation Allied XL.

The first valve 14 includes an inlet 16 adapted to be threadably engaged with the outlet end 12 of the sprinkler system, and an outlet 18. The valve 14 is provided with an operating lever L adapted to manually control the opening and closing of the valve. Any conventional valve such as, for example, a ball valve, gate valve, or globe valve may be used.

A centrally disposed condensate reservoir 20 is provided with an inlet 22 adapted to be threadably coupled to the outlet 18 of the valve 14, and an outlet 24. The condensate reservoir 20 may be produced by swaging a two inch pipe to form the inlet 22 and an outlet 24. The inlet 22 and the outlet 24 are typically swaged to a reduction of one inch. Swaging of the two inch pipe to form the inlet 22 and the outlet 24 eliminates several coupling points, thereby reducing the potential for leakage at these coupling points.

The second valve 30 includes an inlet 32 adapted to be threadably engaged with the outlet 24 of the condensate reservoir 20. The valve 30 is provided with an outlet 34 which may be provided with an externally threaded plug 36 or may in certain instances be connected to a remote server for drainage (not shown). The valve 30 is provided with an operating lever L' adapted to manually control the opening and closing of the valve 30. Any conventional valve such as, for example, a ball valve, gate valve, or globe valve may be used.

In operation, the valves 14 and 30 are normally closed. The pipes of the sprinkler system, of which only the outlet 12 is shown, are maintained under pressure and may contain dry air or in certain instances nitrogen. Periodically, the system must be drained of water formed by condensation, for example. Drainage is commenced by opening the valve 14 by moving the control lever L through ninety degrees. The opening of the valve 14 provided liquid communication between the sprinkler system and the interior of the reservoir 20. As soon as the system had been drained, the lever L of the valve 14 manipulated to close the valve and retain the pressure in the sprinkler system. Thereafter, the valve 30 is opened by moving the control lever L', allowing the condensate collected in the reservoir 20 to be drained away. Once accomplished, the valve 10 is closed completing the draining cycle.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A condensate drain for dry-type sprinkler systems comprising:

a first normally closed valve having an inlet communicating with the sprinkler system, and an outlet;

a second normally closed valve having an outlet communicating with a remote drain; and a one-piece reservoir having a main fluid containing a center chamber of a first dimension and spaced apart inlet and outlet connections of a second dimension less than the first dimension of the center chamber, the inlet being in fluid-tight communication with the outlet of the first valve and the outlet being in fluid-tight communication with the inlet of the second valve.

2. The condensate drain for dry-type sprinkler systems according to claim 1, wherein said first normally closed valve is of the ball valve type.

3. The condensate drain for dry-type sprinkler systems according to claim 1, wherein said first normally closed valve is a gate valve.

4. The condensate drain for dry-type sprinkler systems according to claim 1, wherein said first normally closed valve is a globe valve type.

5. The condensate drain for dry-type sprinkler systems according to claim 1, wherein said second normally closed valve is of the ball valve type.

6. The condensate drain for dry-type sprinkler systems according to claim 1, wherein said second normally closed valve is a gate valve.

7. The condensate drain for dry-type sprinkler systems according to claim 1, wherein said second normally closed valve is a globe valve type.

8. The condensate drain for dry-type sprinkler systems according to claim 1, wherein the outlet of said first normally closed valve is threadably engaged to the inlet of said one-piece reservoir.

9. The condensate drain for dry-type sprinkler systems according to claim 1, wherein the inlet of said second normally closed valve is threadably engaged to the outlet of said one-piece reservoir.

10. The condensate drain for dry-type sprinkler systems according to claim 1, wherein said one-piece reservoir is swaged to form the second diametrical dimension of the center chamber of said one piece reservoir.

11. A condensate drain for dry-type sprinkler systems comprising:

a first normally closed valve having an inlet communicating with a sprinkler system, and an outlet;

a second normally closed valve having an outlet communicating with a remote drain and an inlet; and a one-piece reservoir constructed with approved sprinkler pipe having a main fluid containing center chamber of a first diametrical dimension and spaced apart inlet and outlet connections of a second diametrical dimension less than the first diametrical dimension of the center chamber, the inlet being threadably engaged to the outlet of said first valve and the outlet being threadably engaged to the inlet of second valve.

12. The condensate drain for dry-type sprinkler systems according to claim 11, wherein said first normally closed valve is a ball valve type.

13. The condensate drain for dry-type sprinkler systems according to claim 11, wherein said first normally closed valve is a gate valve type.

14. The condensate drain for dry-type sprinkler systems according to claim 11, wherein said first normally closed valve is a globe valve type.

15. The condensate drain for dry-type sprinkler systems according to claim 11, wherein said second normally closed valve is a ball valve type.

16. The condensate drain for dry-type sprinkler systems according to claim 11, wherein said second normally closed valve is a gate valve type.

17. The condensate drain for dry-type sprinkler systems according to claim 11, wherein said second normally closed valve is a globe valve type.

18. The condensate drain for dry-type sprinkler systems according to claim 11, wherein said one-piece reservoir is swaged to form the second diametrical dimension that is less than the first diametrical dimension of the center chamber of said one-piece reservoir.

19. A condensate drain for dry-type sprinkler systems comprising:

a first normally closed ball valve having an inlet communicating with a sprinkler system, and an outlet;

a second normally closed ball valve having an outlet communicating with a remote drain and an inlet; and a one-piece reservoir constructed having a main fluid containing center chamber of a first diametrical dimension and spaced apart inlet and outlet connections of a second diametrical dimension less than the first diametrical dimension of the center chamber, the inlet being threadably engaged to the outlet of said first valve and the outlet being threadably engaged to the inlet of said second valve.

20. The condensate drain for dry-type sprinkler systems according to claim 19, wherein said one-piece reservoir is swaged to form the second diametrical dimension that is less than the first diametrical dimension of the center chamber of said reservoir.

* * * * *